United States Patent [19]

Zoller et al.

[11] Patent Number: 5,066,841

[45] Date of Patent: Nov. 19, 1991

[54] DUAL PLUNGER SWITCH

[75] Inventors: Jon P. Zoller, Prior Lake; Jeffrey J. Norris, Bloomington, both of Minn.

[73] Assignee: ITT Corporation, New York, N.Y.

[21] Appl. No.: 560,919

[22] Filed: Jul. 31, 1990

Related U.S. Application Data

[63] Continuation-in-part of Ser. No. 378,726, Jul. 12, 1989, abandoned.

[51] Int. Cl.[5] ..... H01H 3/48

[52] U.S. Cl. ..... 200/342; 200/345; 200/314

[58] Field of Search ..... 200/342, 345, 517, 314

[56] References Cited

U.S. PATENT DOCUMENTS 4,933,521 6/1990 Steward, Sr. ..... 200/342

4,940,864 7/1990 Aurand et al. ..... 200/342

*Primary Examiner*—Henry J. Recla

*Assistant Examiner*—Keith Kupferschmid

*Attorney, Agent, or Firm*—Thomas L. Peterson

[57] ABSTRACT

A switch assembly is provided with a short travel switch (16, FIG. 3) activated by a push button that has a long travel both before and after closing of the short travel switch, and which provides a substantially constant spring rate throughout push button travel, with minimal noticeable disruptions. The switch assembly includes an inner plunger (32) which depresses the short travel switch, and an outer plunger (44) or keystem coupled to the push button. An inner spring device (46) couples the inner plunger to the housing, and an outer spring device (52) couples the two plungers, so the springs act in series. The preloads of the two spring devices are substantially the same, and the inner spring has a lower spring rate than the outer spring. As the keystem is depressed, both springs begin to compress until the inner plunger contacts the short travel switch. Continued depression of the push button and keystem results in compression of only the outer spring, there being a smooth transition because the preload of the outer spring has already been exceeded. The mechanism lies in a passage of a housing, the housing including a bar (102, FIG. 5) that extends across the passage, with the keystem having grooves that receive the bar end portions. Pin sockets (116) are mounted on the middle of the bar to receive lamp terminals, and a pair of conductors (142) have flattened ends (144) receiving the pin sockets.

6 Claims, 5 Drawing Sheets

FIG. 6
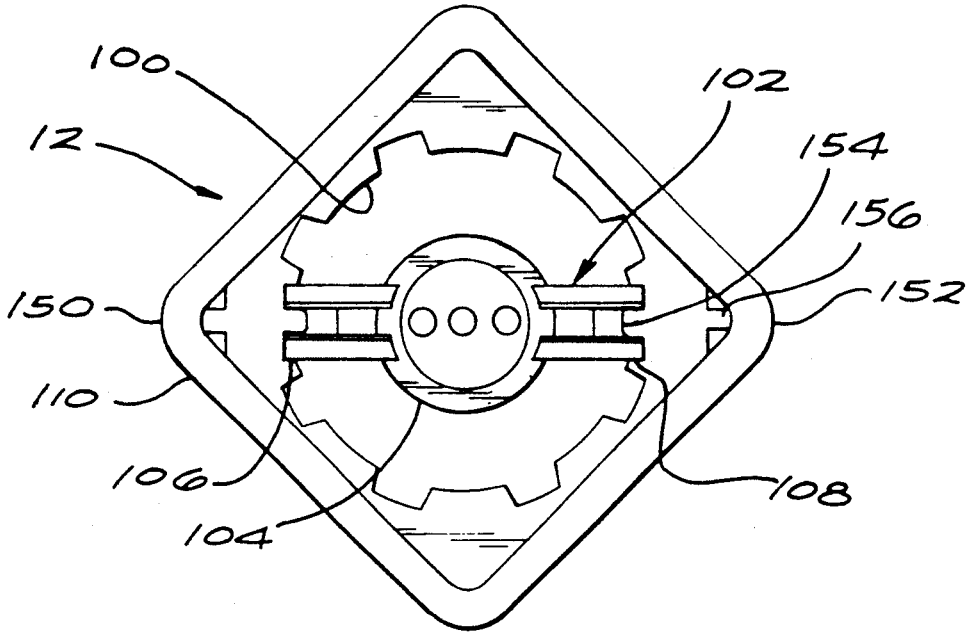
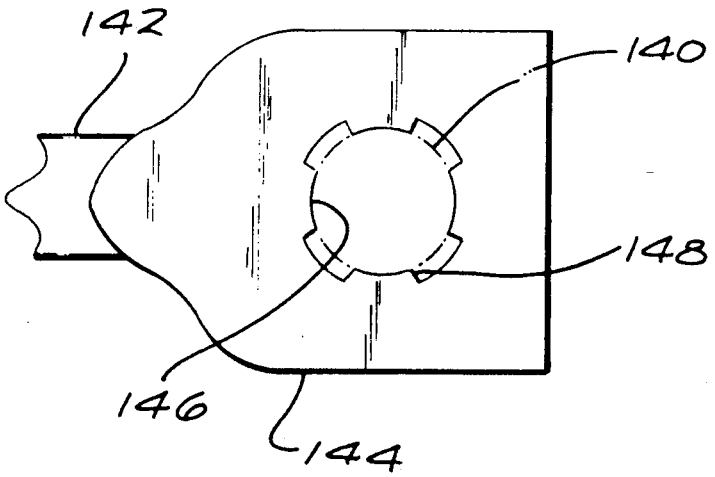
FIG. 7

DUAL PLUNGER SWITCH

CROSS-REFERENCE TO RELATED APPLICATION

This is a continuation-in-part of abandoned U.S. patent application Ser. No. 378,726 filed July 12, 1989.

BACKGROUND OF THE INVENTION

Tiny short travel switches are available, which may include a small snapdome whose middle can be depressed until the snapdome snaps past center and contacts a terminal. U.S. Pat. No. 3,967,084 shows one example of this type of switch. The total travel of a button lying against the snapdome may be 15 mil (one mil equals one thousandth inch). The availability of such low cost small travel switches has the potential to reduce the cost of push-button switches. However, one type of commonly used push-button switch has a long travel such as about 3/16ths inch (187 mil), with the force opposing depression increasing gradually, such as is obtained with a single spring. In order to enable acceptance of low cost push-button switches using the low cost short travel switches, it is desirable to construct the push-button switches so they have the same long stroke, smooth action, as present common push button assemblies.

One prior art push-button switch using a short travel switch is shown in U.S. Pat. No. 4,156,802. That patent describes a switch assembly which uses two springs in parallel. As the push button is depressed, only a first or key spring is initially deflected until the plunger makes contact with the short travel switch. The required load on the push button increases greatly until the preload of the second or follower spring is overcome and the follower spring begins to deflect. When the push button load is sufficient, it operates the short travel switch and the push button can be deflected a short distance thereafter. The large increase in force between complete compression of the key spring and the beginning of deflection of the follower spring provides a false tactile feedback indicating that the short travel switch has been operated. Also, the push button does not have a substantially continuous smooth increase in force as the push button is deflected, to mimic the single spring switch that is presently commonly used.

Where the push-button switch is to be illuminated, as by a lamp immediately under the push button, a low cost but reliable electrical connection is required between the lamp at the middle of the housing around which the plunger moves, and the outside of the housing where current is applied. A low cost but reliable switch assembly based upon a short travel switch, which provided characteristics mimicking those of presently available push-button switches, and which enabled the push button to be illuminated by providing current to a lamp at the middle of the housing, in a low cost and reliable manner, would be of considerable value.

SUMMARY OF THE INVENTION

In accordance with one embodiment of the present invention, a switch assembly is provided which uses a short travel switch that is operated by a push button with deflection vs. force characteristics that vary smoothly in a manner mimicking prior long travel push-button switches. The switch assembly includes inner and outer plungers, with the outer plunger depressed by the push button, and the inner plunger having an actuator part that depresses the short travel switch. Two spring devices are provided, including an inner spring device that biases the inner plunger away from the short travel switch, and an outer spring device that biases the outer plunger away from the inner plunger. The two spring devices have about the same preload, but the inner spring device has a lower spring rate. As the push button is depressed and first contacts the short travel switch, the outer spring device is partially compressed. Further force compresses the outer spring device until the switch is operated, and the push button can then be depressed further, all with moderate spring rates and with relatively smooth transitions where the spring rate changes.

A lamp can be held within a hollow outer plunger by a bar that extends between opposite sides or corners of the housing, the outer plunger having grooves that receive the bar to allow the plunger to move. Conductors that carry current to the lamp extend along the bar, the bar having end portions that extend outwardly and having grooves along the bar end portions and along the corners of the housing to locate the conductors. The conductor assemblies can include a pin socket mounted on the middle of the bar and conductors of substantially constant cross section extending from there to the outside of the housing, with the end of each conductor flattened to fit closely around the projecting end of a pin socket.

The novel features of the invention are set forth with particularity in the appended claims. The invention will be best understood from the following description when read in conjunction with the accompanying drawings.

BRIEF DESCRIPTION OF THE DRAWINGS

FIG. 6 is a view taken on the line 6—6 of FIG. 5, but without the conductor assemblies in place.

FIG. 7 is a plan view of the end of a conductor of the switch assembly of FIG. 5.

DESCRIPTION OF THE PREFERRED EMBODIMENTS

Figure 1:
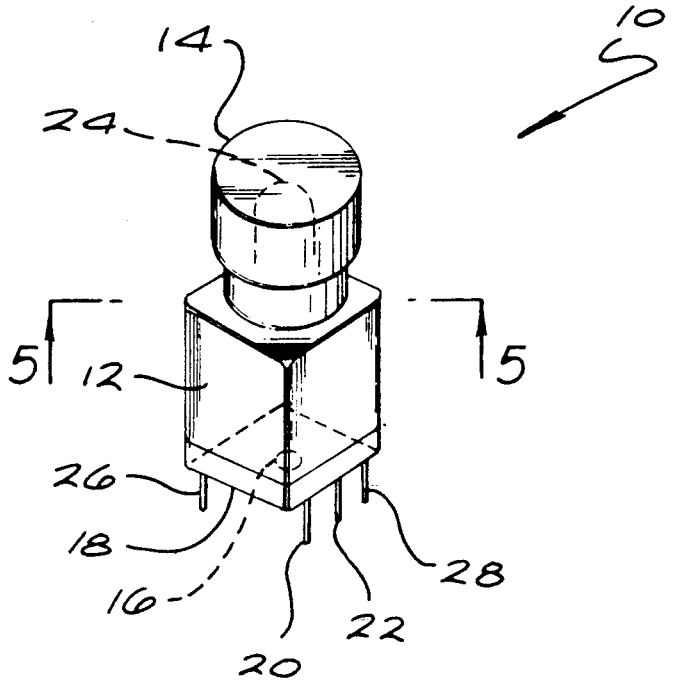
FIG. 1 is a simplified perspective view of a switch assembly constructed in accordance with the present invention.

FIG. 1 illustrates a switch assembly 10 of the present invention, which includes a switch housing 12 and a push button 14 that can be depressed to close a short travel switch 16 within the housing. The housing includes an end cap 18 from which project several terminals, including a pair of switch terminals 20, 22 of switch 16. The switch can be a lighted type which includes lamp 24 that illuminates the push button. A pair of lamp energizing terminals 26, 28 also project from the end cap to allow voltage to be supplied to the lamp.

Figure 3:
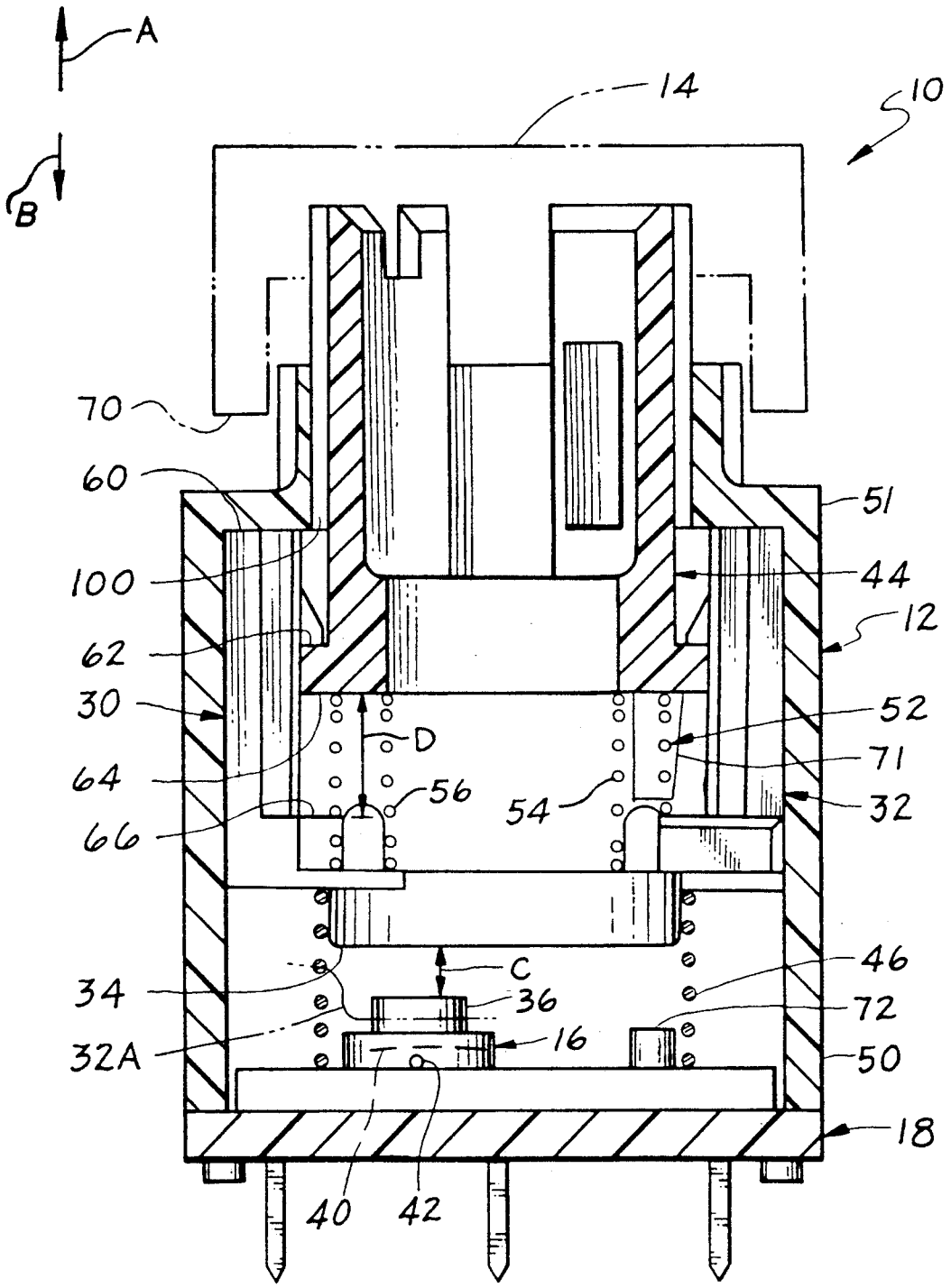
FIG. 3 is a partial sectional side view of the switch assembly of FIG. 1, but with the inner plunger 32 shown in full.

FIG. 3 illustrates details of the switch assembly 10. The assembly includes a plunger assembly 30 slideably mounted in the housing to move in outer and inner directions A and B. The plunger assembly includes an inner plunger 32 with an actuator part 34 that can depress a button 36 on the short travel switch 16 to close it and connect terminals 20, 22 by deflecting a snap dome 40 of the switch against a contact 42 in the switch. The plunger assembly also includes an outer plunger or keystem 44 that can move inwardly and outwardly relative to the inner plunger. An inner spring device or spring 46 biases the inner plunger 32 away from the inner end portion 50 of the housing (and toward the outer end portion 51) and away from the short travel switch 36. An outer spring device or spring 52 which includes two coil spring elements 54, 56 biases the outer plunger 44 outwardly with respect to the inner plunger 32. The inner plunger has a shoulder 60 that limits its outward movement within the housing. The keystem has a shoulder 62 that abuts a corresponding shoulder on the inner plunger to limit outward movement of the keystem.

When the push button 14 is depressed or moved inwardly, to depress the keystem 44, both springs 52, 46 are compressed, although the inner spring 46 has a lower spring rate and is compressed move rapidly than the outer spring. After moderate depression of the push button, the actuator part 34 of the inner plunger engages the button 36 on the short travel switch. Further depression of the push button causes compression primarily of the outer spring 52 and slight depression of the button 36. At about the middle of compression of the outer spring 52, sufficient force is applied that the switch 16 is closed. The push button and keystem 44 can continue to be depressed until a protrusion 71 on the keystem engages a stop 72 on the base 18. The position of the inner plunger 32 in the switch operating position is indicated at 32 A. When the push button is released, it moves outwardly to an unoperated position.

The preloads of the inner and outer springs 46, 52 are substantially the same (neither is more than 50% greater than the other). As a result, both springs start to be compressed when the push button is depressed. However, the inner spring 46 has a much lower spring rate so it becomes substantially fully compressed when the outer spring 52 is only partially compressed. Once the inner spring cannot be further compressed (the short travel switch is in the way), additional force on the push button results in greater force on the short travel switch 16 until it is suddenly operated.

Figure 4:
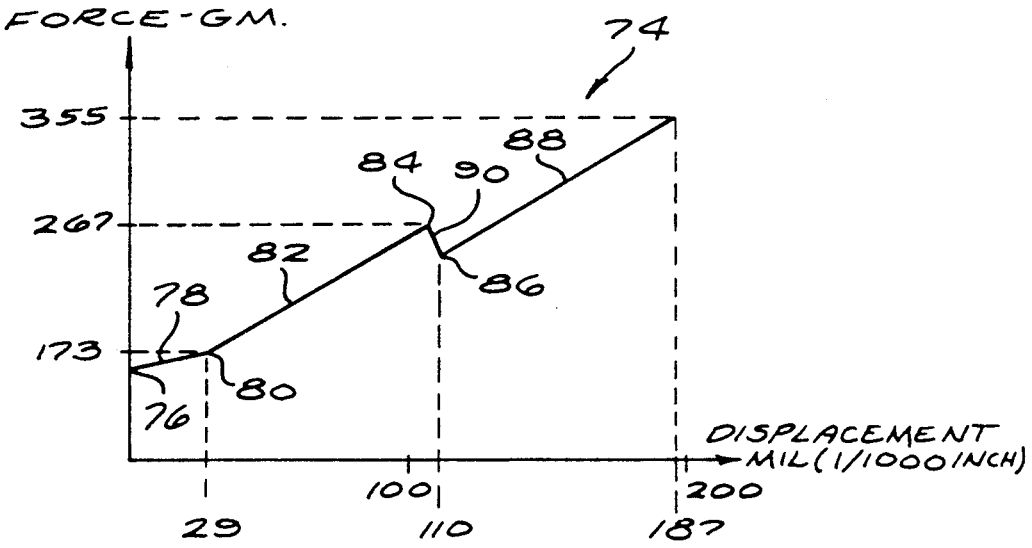
FIG. 4 is a graph showing variation in force with displacement of the push button of the switch assembly of FIG. 1.

FIG. 4 includes a graph 74 which illustrates the force vs. displacement characteristics of the push button 14 of the switch assembly of FIG. 3. In the unloaded position of FIG. 3, both spring devices or springs 46,52 are preloaded, the preloads of each spring being 160 grams (each spring element 54, 56 has a preload of about 80 gm), with a tolerance of ±10% (i.e., 144 gm to 176 gm). The inner spring 46 has a spring rate of 650 gm per inch, while the two spring elements of the outer spring 52 have a combined spring rate of 1400 gm per inch, both spring rates having a tolerance of ±5%. The travel C (FIG. 3) of the actuator part of the inner plunger is 20 mil (one mil=1/1000th inch). The travel D of the keystem 44 relative to the inner plunger is 75 mil. The travel of the button 36 of the short travel switch is 14 mil, with 9 mil depression before snap over and 5 mil travel after snap over.

In FIG. 4, displacement begins at the point 76 where a force exceeding the preload of either spring is applied, that being 160 gm. The graph segment 78 reflects primarily the spring rate of the soft inner spring. At the point 80, when the push button has traveled 29 mil the inner plunger is pressing against the button of the short travel switch. The inner plunger has traveled 20 mil, while the outer plunger has traveled 9 mil. The next graph segment 82 substantially represents compression of the outer spring. In this segment the force is increasing against the button of the short travel switch. It requires a force of 267 gm on the push button to close the short travel switch. At the point 84, the short travel switch snaps closed and travels an additional 5 mils until its button bottoms at 86. The final graph segment 88 represents deflection only of the outer spring.

The point 80 of the graph, where the push button has traveled 29 mil and contacts the short travel switch, is a location of smooth transition. There is only a moderate change in spring rate at point 80 and no additional preload to overcome to continue push button deflection, so there is not a noticeable tactile feedback that would erroneously indicate closure of the switch. In the graph segment 90 when the button suddenly moves forward by 5 mil as the short travel switch snaps, there is a small tactile feedback which might indicate closure of the switch, which is what is actually happening. The spring rate along the last segment 88 is almost the same as along the previous segment 82 and the difference is normally not noticeable. Thus, the person pushing the push button feels a substantially constant increase in resistance as the push button is depressed along its total deflection of 3/16ths inch (0.187 mil) with the only slightly noticeable feedback at the point 84 when the short travel switch snaps closed. The action of the push button therefore closely mimics the action of a prior art push-button switch in which a single spring was depressed along the entire 3/16ths inch movement of the button, with a constant spring rate along most of the travel. However, the use of a short travel switch enables a low cost switching assembly to be provided. Applicant constructs the inner plunger 32 and outer plunger or keystem 44 as an assembly 30 which includes the spring elements 54, 56 of the outer spring 52.

Figure 2:
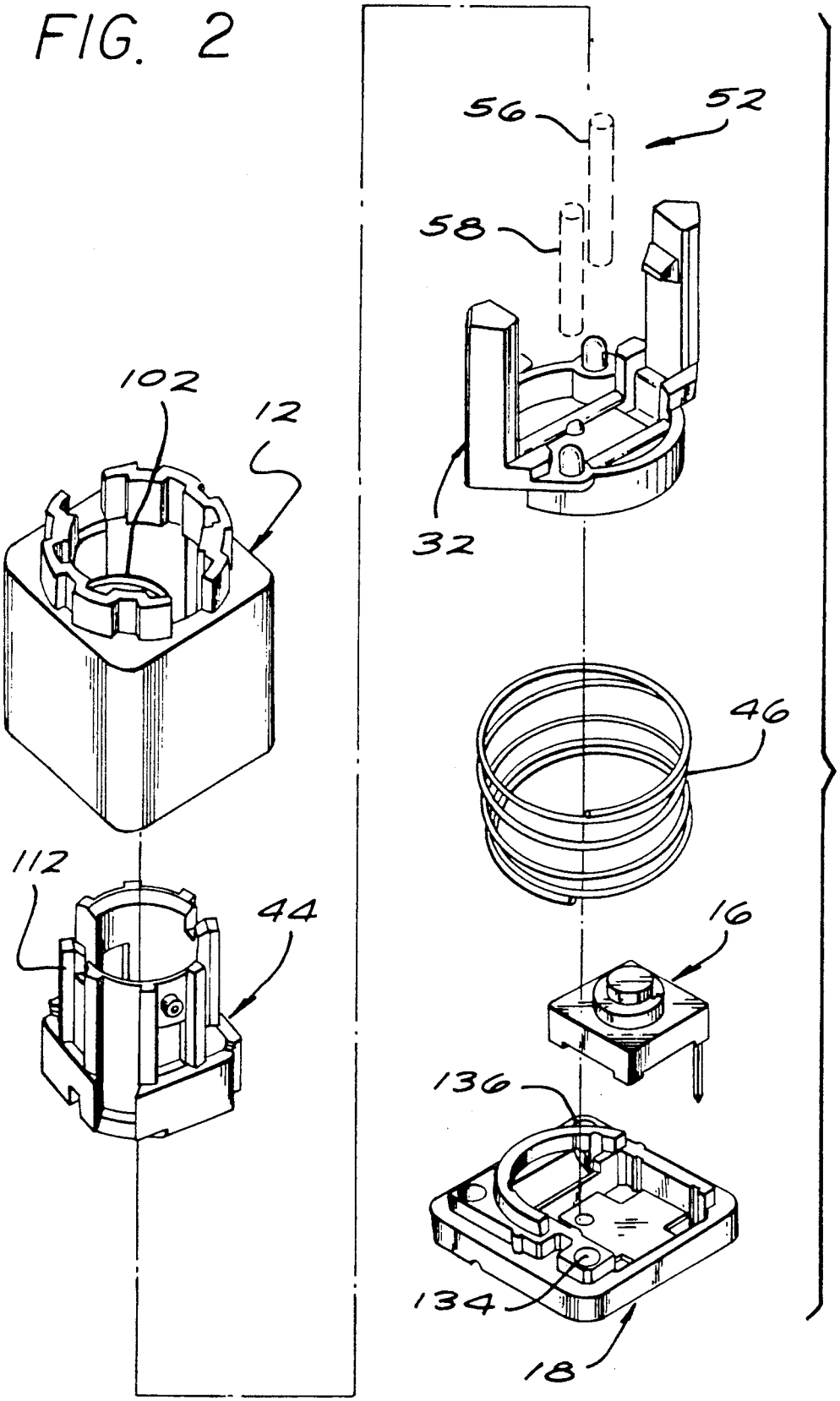
FIG. 2 is an exploded perspective view of some of the parts of the switch assembly of FIG. 1.
Figure 5:
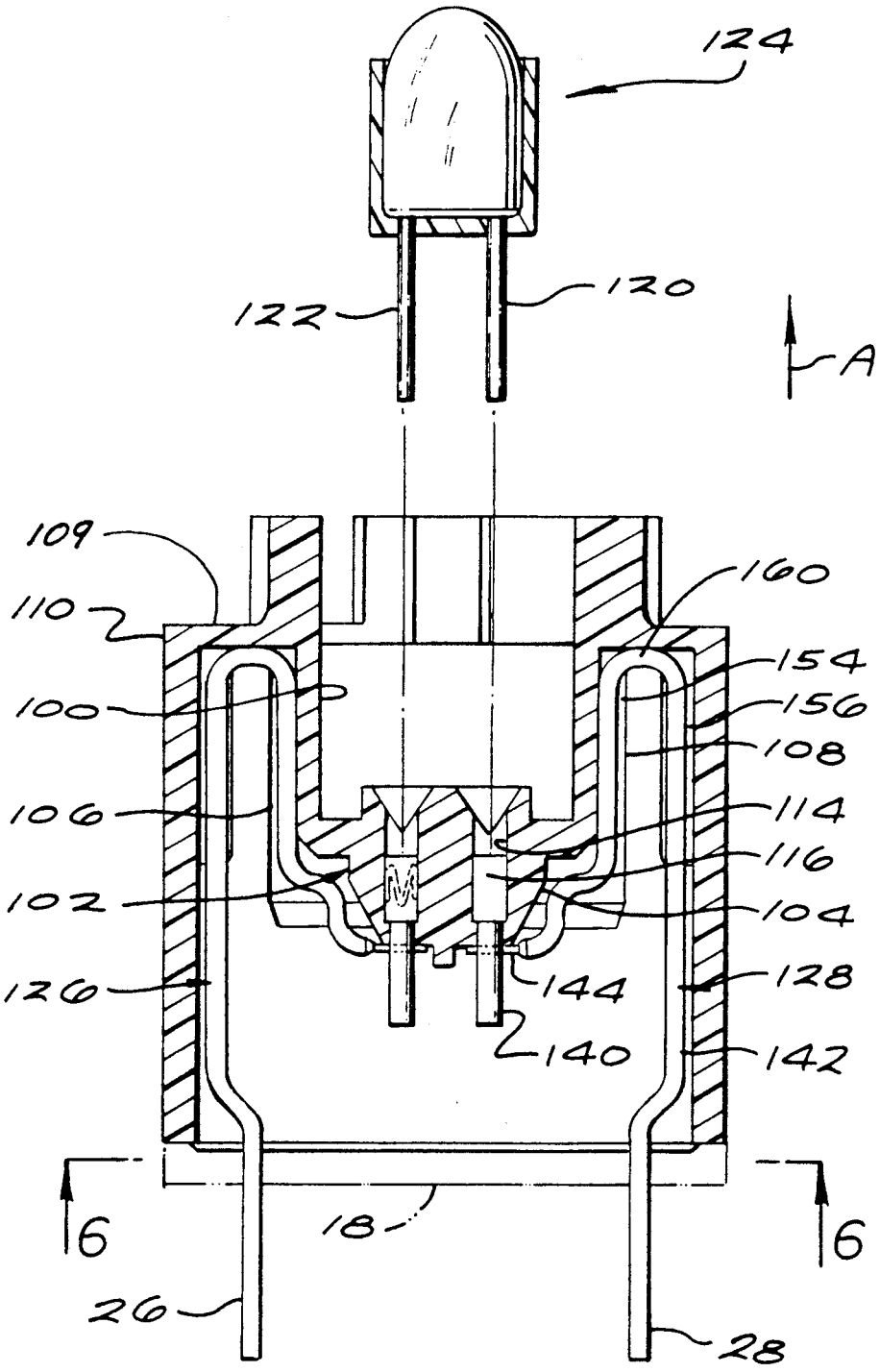
FIG. 5 is a sectional side view taken on the line 5—5 of FIG. 1, but showing only the housing and conductor assemblies mounted thereon.

In many applications, it is desirable to illuminate the push button with a lamp (incandescent, light emitting diode, or other type) immediately inward of the push button. As shown in FIGS. 5 and 6, the housing 12 includes a passage 100 along which the plungers move, and a lamp-mounting bar 102 that extends across the passage. The bar has a middle 104 and has opposite end portions 106, 108 that extend from the middle 104 to shell housing portion 110. As shown in FIG. 2, the keystem 44 has grooves 112 that receive the bar end portions to enable the keystem to slide inwardly and outwardly. The middle 104 (FIG. 5) of the bar has a pair of holes 114 that hold pin sockets 116 for receiving the pin terminals 120, 122 of a lamp assembly 124. The pin sockets 116 are part of conductor assemblies 126, 128 that form the lamp energizing terminals 26, 28 that project through holes (134, 136 in FIG. 2) at the inner end of the housing.

Each pin socket 116 has an outer end that receives a lamp pin terminal and an inner end 140 that projects inwardly from the inner side, or inner end of the bar middle 104. Each conductor assembly such as 128 includes an elongated conductor 142 which has a substantially constant cross section along its length, and which extends between the inner end 140 of the pin socket and the lamp energizing terminal 28 formed by an end of the conductor. However, the outer end 144 of the elongated conductor is flattened to enlarge it so as to enable it to form with a hole 146 as shown in FIG. 7. The inner end 140 of the pin socket projects through hole 146, with deflectable fingers 148 providing a tight fit. This arrangement minimizes the cost by allowing the elongated conductor to be easily and reliably connected to the pin socket, the elongated conductor also forming the lamp energizing terminal projecting from the outside of the housing.

The end portions 106, 108 of the lamp-mounting bar are formed to facilitate reliable mounting of the elongated conductors 142. As shown in FIG. 5, each bar end portion extends in an outward direction A from the bar middle 104 to an outer part 109 of the shell portion 110 of the housing, at a housing location adjacent to one of a pair of opposite corners 150, 152 (FIG. 6) of the housing. The bar end portions also form lengths of grooves 154 (also shown in FIG. 6, which does not show the conductors) in which the elongated conductors 142 are nestled. The housing is also formed with projections that form grooves 156 along the inside corners of the housing along which the elongated conductor extends. The elongated conductor is bent to have a long looped portion 160 with ends that nestle closely in the grooves. The looped portions maintain a controlled orientation of the elongated conductor. The elongated conductor is held at its opposite ends to the pin socket 116 and the end cap 18 of the housing to hold it in place. In this way, the elongated conductor is closely maintained in position in extension along a path which avoids interference with the moving mechanism of the switch assembly, while providing reliably holding of the conductor.

Thus, the invention provides a switch assembly that uses a short travel switch in an arrangement that provides smooth resistance to depression of a push button that operates the short travel switch. The mechanism includes an inner plunger with an actuator part that contacts a short travel switch to operate it, and an outer plunger or keystem that is moved by the push button. An inner spring couples the inner plunger to the housing while an outer spring operating in series with the inner spring couples the inner and outer plungers. Both springs have about the same preload but the inner spring has a lower spring rate. Thus, as the push button is depressed, the inner spring is compressed first, but at the end of its compression the outer spring is partially compressed and there is a smooth transition to compression substantially only of the outer spring. A small tactile feedback is generated only when the short travel switch is actually operated, and the push button can be depressed a distance thereafter. This arrangement allows the switch assembly to operate in a manner closely mimicking prior art push-button switches, with the only substantial tactile feedback indicating a true operation of the switch. Provision for a lamp is made by a bar that extends along a passage in which the outer plunger moves. Elongated conductors that couple pin sockets on the bar middle to terminals at the outside of the housing can extend along grooves in the bar that extend in an outward direction, and along the corners of the housing. The elongated conductors have a substantially constant cross section, but they have flattened ends with fingers that receive the pin sockets.

Although particular embodiments of the invention have been described and illustrated herein, it is recognized that modifications and variations may readily occur to those skilled in the art and consequently it is intended to cover such modifications and equivalents.

What is claimed is:

1. A switch assembly of the type that is operable by pressing a button or the like inwardly, and wherein release of the button or the like allows it to move outwardly to an unoperated position, comprising:

a housing having inner and outer end portions, said outer end portion lying outwardly of said inner end portion;

a plunger assembly slideably mounted to move in opposite inner and outer directions in said housing and including inner and outer plungers and an outer spring resiliently biasing the outer plunger outwardly with respect to the inner plunger, each of said plungers being separately moveable in opposite inner and outer directions and said inner plunger being moveable along a predetermined path;

an inner spring biasing said inner plunger outwardly with respect to said housing;

a short travel switch lying in said housing inward of said inner plunger and having a deflectable part lying along the path of said inner plunger, said switch being operable by depression of said deflectable part;

said outer plunger having a shoulder that abuts said inner plunger at a position that preloads said outer spring;

the preloads and spring rates of said inner and outer springs being chosen so that said outer spring is partially compressed from the position at which said shoulder abuts said inner plunger, when said inner plunger first contact said deflectable part of said short travel switch.

2. The switch assembly described in claim 1 wherein:

the spring rate of said inner spring is less than the spring rate of said outer spring, and said short travel switch requires a force to operate it which is less than the force required to fully compress said outer spring.

3. The switch assembly described in claim 1 wherein:

said housing has a passage within said shell portion along which said plunger assembly slides, and said housing includes a lamp-mounting bar extending across said passage;

said shell portion has an outer shell part, and said bar has a middle and has opposite end portions lying close to but spaced from said shell corners, said bar end portions extending in outward directions from said bar middle to said shell outer part;

a pair of pin sockets on said bar middle;

a pair of elongated conductors each having a first conductor portion coupled to one of said pin sockets and extending in an outward direction along a bar end portion, a middle conductor portion extending in a substantially 180° turn, and a second conductor portion extending inwardly along the inside of said corners.

4. A switch assembly of the type that is operable by pressing a button or the like inwardly, and wherein release of the button or the like allows it to move outwardly to an operated position, comprising:

a housing having inner and outer end portions;

a short travel depressible operable switch mounted in said housing;

inner and outer plungers each slideably mounted in said housing in inner and outer directions, said plungers being separately moveable, so each can move in opposite inner and outer directions, said inner plunger lying generally inward of said outer plunger, and said inner plunger having an actuator part which depresses said short travel switch as said inner plunger moves inwardly to a switch operating position;

an inner spring coupled to said housing and inner plunger, said inner spring urging said inner plunger outwardly away from said switch operating position;

an outer spring which is coupled to said inner and outer plungers and which urges said outer plunger outwardly;

said inner and outer springs each having a predetermined preload and a predetermined spring rate, chosen so the force against said inner plunger required to move it to said switch operating position is greater than the preload of said outer spring so said outer spring is already partially compressed when the short travel switch starts to be depressed, whereby to provide a relatively smooth transition between the times before and after depression of the short travel switch.

5. The switch assembly described in claim 4 wherein:

said inner spring has a spring rate less than half that of said outer spring and said inner plunger has a total travel distance less than half the maximum travel of said outer plunger to its most inward position, whereby to assure considerable travel of said outer plunger after said switch is operated.

6. The switch assembly described in claim 4 wherein:

the preloads of said inner and outer springs are about the same, while the spring rate of said outer spring is greater than the spring rate of said inner spring.

* * * * *